US006131753A

United States Patent [19]

Lynch

[11] Patent Number: 6,131,753

[45] Date of Patent: Oct. 17, 2000

[54] VACUUM JAR APPARATUS

[76] Inventor: John Berrien Lynch, 1127 Miami Blvd., Delray Beach, Fla. 33483-3439

[21] Appl. No.: 09/313,307

[22] Filed: May 17, 1999

[51] Int. Cl.[7] ..... B65B 31/04

[52] U.S. Cl. ..... 215/228; 215/260; 215/270; 220/212; 220/240

[58] Field of Search ..... 215/228, 260, 215/262, 269, 270; 220/212, 231, 240

[56] References Cited

U.S. PATENT DOCUMENTS

| | | | |
|---|---|---|---|
| 5,469,979 | 11/1995 | Chiou | 215/228 |
| 5,546,997 | 8/1996 | Miramon | 215/228 X |
| 5,558,243 | 9/1996 | Chu | 220/212 |
| 5,564,581 | 10/1996 | Lin | 215/228 |
| 5,651,470 | 7/1997 | Wu | 220/212 |
| 5,692,632 | 12/1997 | Hsieh et al. | 220/212 |
| 5,944,212 | 8/1999 | Chang | 220/212 |

*Primary Examiner*—Stephen K. Cronin
*Attorney, Agent, or Firm*—Oltman, Flynn & Kubler

[57] ABSTRACT

A vacuum jar apparatus is provided, including a jar having a jar wall terminating at a jar upper end in a jar opening surrounded and defined by a jar upper rim; and a jar lid structure including a sealing panel for resting against the jar upper rim and thereby closing and sealing the jar, and including a mechanism for evacuating air from within the jar, the mechanism for evacuating air including a chamber within the lid structure having an internal volume which is enlargeable and reducible, a first air passing port between the chamber and the jar, a first check valve in the first air passing port oriented to permit air to pass from the jar into the chamber and to prevent air from passing from the chamber into the jar through the first air passing port, a second air passing port between the chamber and the atmosphere outside the chamber and the jar, a second check valve in the second air passing port oriented to pass air from the chamber into the atmosphere outside the chamber and the jar and to prevent air from passing from the atmosphere outside the chamber and the jar into the chamber; and a mechanism for enlarging and a mechanism for reducing the volume of the chamber; so that sequentially enlarging and reducing the volume of the chamber progressively expels air from the jar through the chamber and into the atmosphere outside the chamber and the jar, thereby progressively rarefying air remaining in the jar so that the interior of the jar approaches a vacuum.

8 Claims, 5 Drawing Sheets

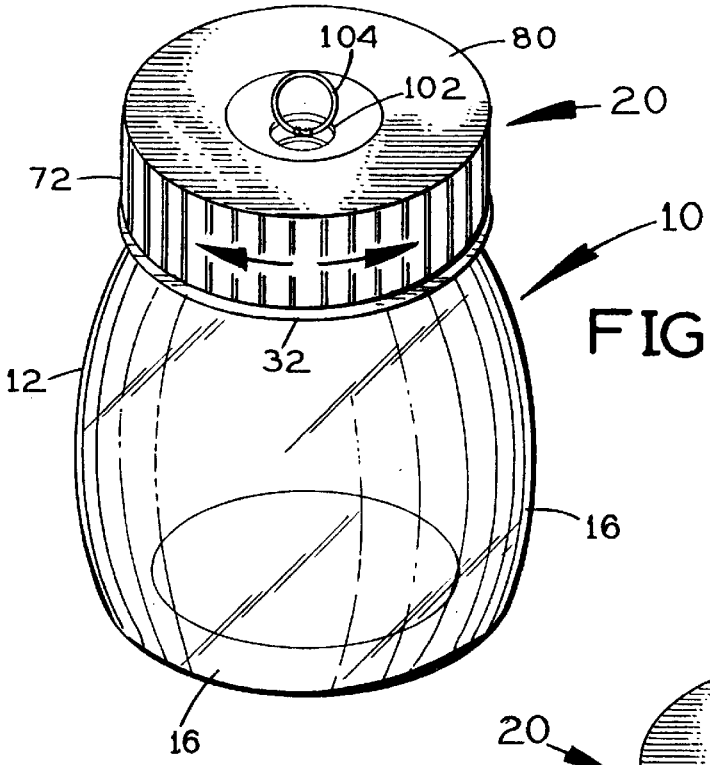
FIG. 1
FIG. 2
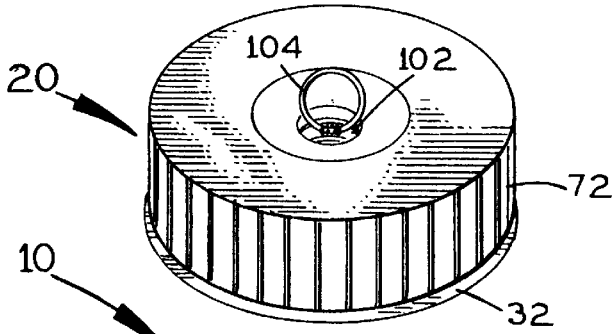
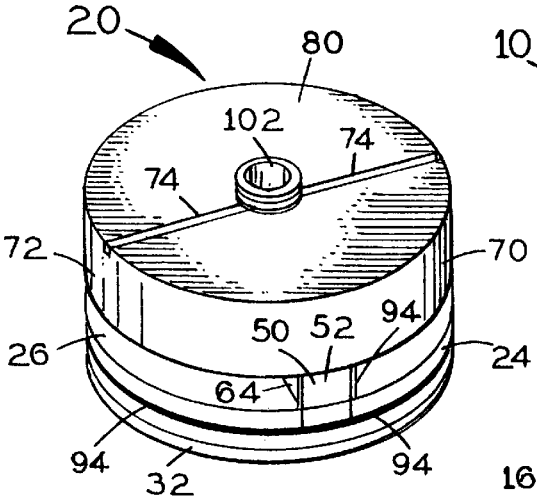
FIG. 3
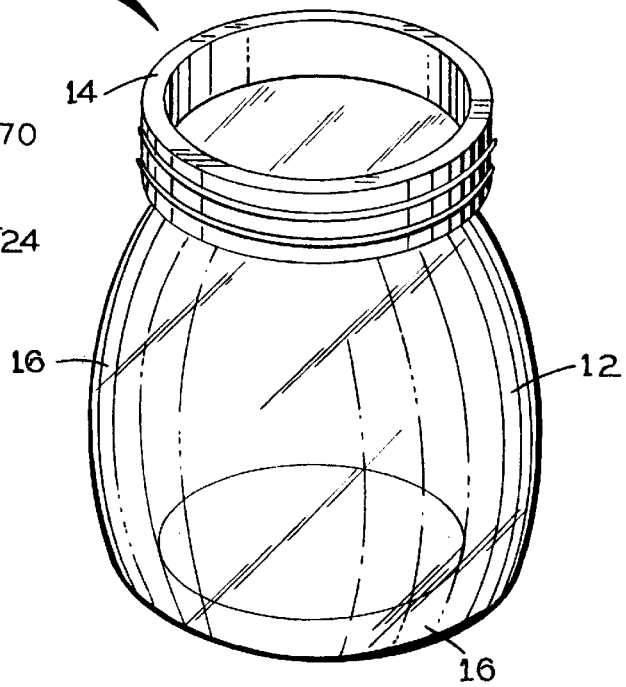

VACUUM JAR APPARATUS

BACKGROUND OF THE INVENTION

1. Field of the Invention

The present invention relates generally to the field of canning and food preservation. More specifically the present invention relates to a vacuum jar apparatus including a bell jar and a vacuum pump lid which both closes and seals the jar and pumps air out of the sealed jar. The lid includes a lid lower portion in the form of a sealing disk having a disk lower face covered with a sealing gasket material for extending across and sealing the jar upper rim, and having a downwardly extending circumferential lip for receiving the jar upper rim to center the lid on the jar, and a pumping mechanism for evacuating air including a chamber within the lid structure having an internal volume which is enlargeable and reducible. A first air passing port is provided between the chamber and the jar, and a first check valve in the first air passing port oriented to permit air to pass from the jar into the chamber and to prevent air from passing from the chamber into the jar through the first air passing port. A second air passing port is provided between the chamber and the atmosphere outside the chamber and the jar, and a second check valve in the second air passing port oriented to pass air from the chamber into the atmosphere outside the chamber and the jar and to prevent air from passing from the atmosphere outside the chamber and the jar into the chamber. A mechanism for enlarging and a mechanism for reducing the volume of the chamber is provided, so that sequentially enlarging and reducing the volume of the chamber progressively expels air from the jar through the chamber and into the atmosphere outside the chamber and the jar, thereby progressively rarefying air remaining in the jar to ultimately approach a vacuum.

2. Description of the Prior Art

There have long been jars and cans for retaining foods and other perishable items such as paints which have a very short shelf life if exposed to air outside the jar or can. A problem with prior jars has been that there is no practical or efficient way for an ordinary consumer to sufficiently evacuate air within the jar to preserve the contents. A problem with prior cans is, once again, that the ordinary consumer has no practical way of evacuating air within the can to preserve its contents, and then when the can is sealed it cannot be opened and subsequently re-evacuated, so that all of the contents must be used at one time to avoid loss through spoilage or solidification.

It is thus an object of the present invention to provide a vessel which includes a lid with a manual air pump for pumping air out of the vessel to preserve the vessel contents.

It is another object of the present invention to provide such a vessel in which the manual air pump is operated by twisting the lid circumferential outer wall back and forth, for convenient manual operation.

It is still another object of the present invention to provide such a vessel which is conventional in general appearance and suitable for compact stacking and storing.

It is finally an object of the present invention to provide such a vessel which is durable and inexpensive to manufacture.

SUMMARY OF THE INVENTION

The present invention accomplishes the above-stated objectives, as well as others, as may be determined by a fair reading and interpretation of the entire specification.

A vacuum jar apparatus is provided, including a jar having a jar wall terminating at a jar upper end in a jar opening surrounded and defined by a jar upper rim; and a jar lid structure including a sealing panel for resting against the jar upper rim and closing and sealing the jar, and a mechanism for evacuating air from within the jar.

The sealing panel preferably is a sealing disk having a circumferential edge and a sealing disk upper face and a sealing disk lower face, and the mechanism for evacuating air preferably includes a substantially central valve opening in the sealing disk; at least one air intake port in the sealing disk located between the valve opening and the circumferential edge of the sealing disk, the air intake port being fitted with a check valve oriented to pass air exiting the jar and to prevent air from entering the jar through the air intake port; a hollow disk wing structure extending upwardly from and sealingly joined to the sealing disk upper face and extending over and enclosing the air intake port, the disk wing structure being configured substantially as a truncated wedge-shaped box having a circumferential wing outer end wall along the circumferential edge of the sealing disk, a wing inward end wall along the intake port, and a wing top wall and two opposing wing side walls sealingly interconnected to both of the wing end walls, each of the wing side walls having a wing side wall port fitted with a check valve oriented to permit air within the disk wing structure including air drawn up from the jar to exit the disk wing structure over the sealing disk upper face; a lid upper portion including an annular side wall integrally joined to a hollow divider duct extending diametrically across the interior of the annular side wall, and a lid top wall joined to the annular side wall and to the lid top wall, the tubular divider duct including two duct side walls and a duct top wall, a substantially central upright tubular vacuum relief passageway in fluid communication with the tubular divider duct and opening through the lid top wall, two divider duct ports in each divider duct side wall, one on each side of the vacuum relief passageway, each of the duct ports being fitted with a check valve oriented to pass air into the tubular divider duct, and into the vacuum relief passageway and to prevent air from moving out of the tubular divider duct through the duct ports, the divider duct and the disk wing structure defining between them two air receiving and expelling chambers; a closure mechanism at the lower end of the vacuum relief passageway for preventing air from exiting the jar through the vacuum relief passageway; so that rotating the lid upper portion in one rotational direction causes the divider duct to advance away from one wing side wall and thereby draw air out of the disk wing structure through the wing side wall port and into a chamber between the disk wing structure and the divider duct and simultaneously to draw air out of the jar and into the disk wing structure through the air intake port, and rotating the lid upper portion in the opposing rotational direction closes the chamber between the disk wing structure and the divider duct and thereby causes air previously drawn into the space between the disk wing structure and the divider duct to be forced through one of the divider duct ports and into the divider duct, whereupon the air exits the lid structure through the vacuum relief passageway, so that air within the jar is progressively rarified.

The closure mechanism preferably is a valve ball removably fitted within the passageway and sealingly seated into the valve opening for permitting air to exit but not to enter the jar through the vacuum relief passageway, the apparatus additionally including a vacuum relief valve assembly including a valve disk resting on top of the lid top wall and over the vacuum relief passageway; a finger engaging ring pivotally secured to the valve disk upper surface to pivot upright for gripping by a user finger and to pivot down against the valve disk so that the ring is not accidentally bumped and the valve disk dislodged from the passageway; a valve cable interconnecting the valve disk and the valve ball; so that the cable permits the valve disk to rise and move laterally from the passageway upper opening to release air pumped out of the chamber and jar without dislodging the valve ball, and permits a user to admit air into the jar to equalize pressure between the interior of the jar and the surrounding atmosphere so that the lid structure is readily removably from the jar by pulling the finger engaging ring upwardly and thereby pulling the cable taut and pulling further to lift the valve ball off the valve opening, admitting air outside the apparatus through the vacuum relief passageway and into the jar.

The lower face of the sealing disk preferably includes sealing gasket material for contacting and sealing the jar upper rim and the sealing disk preferably includes a downwardly extending circumferential lip for receiving the jar rim to center the lid structure on the jar. The apparatus preferably includes two of the air intake ports which are diametrically opposed and are each located half way between the valve opening and the circumferential edge of the sealing disk. The lid top wall has a top wall upper surface which preferably is recessed sufficiently at its center to bring the finger engaging ring below the level of the remainder of the lid upper surface when the finger engaging ring is pivoted down against the lid top wall.

A vacuum vessel apparatus is further provided, including a vessel having a vessel wall terminating at a vessel upper end in a vessel opening surrounded and defined by a vessel upper rim; and a vessel lid structure including a sealing panel for resting against the vessel upper rim and thereby closing and sealing the vessel, and including a mechanism for evacuating air from within the vessel, the mechanism for evacuating air including a chamber within the lid structure having an internal volume which is enlargeable and reducible, a first air passing port between the chamber and the vessel, a first check valve in the first air passing port oriented to permit air to pass from the vessel into the chamber and to prevent air from passing from the chamber into the vessel through the first air passing port, a second air passing port between the chamber and the atmosphere outside the chamber and the vessel, a second check valve in the second air passing port oriented to pass air from the chamber into the atmosphere outside the chamber and the vessel and to prevent air from passing from the atmosphere outside the chamber and the vessel into the chamber; and a mechanism for enlarging and a mechanism for reducing the volume of the chamber; so that sequentially enlarging and reducing the volume of the chamber progressively expels air from the vessel through the chamber and into the atmosphere outside the chamber and the vessel, thereby progressively rarefying air remaining in the vessel so that the interior of the vessel approaches a vacuum.

A vacuum jar is further provided wherein the sealing panel is a sealing disk having a circumferential edge and a sealing disk upper face and a sealing disk lower face, and where the mechanism for evacuating air includes a substantially central valve opening in the sealing disk; a hollow disk wing structure extending upwardly from and sealingly joined to the sealing disk upper face, the disk wing structure being configured substantially as a box having a wing outer end wall adjacent to the circumferential edge of the sealing disk, a wing inward end wall, and a wing top wall and two opposing wing side walls sealingly interconnected to both of the wing end walls, each of the wing side walls having a wing side wall port fitted with a wing side wall check valve oriented to permit air within the disk wing structure to exit the disk wing structure over the sealing disk upper face; at least one wing structure air intake port in the sealing disk located between the valve opening and the circumferential edge of the sealing disk and opening inside the disk wing structure, the air intake port being fitted with a wing structure check valve oriented to pass air exiting the jar and to prevent air from entering the jar through the wing structure air intake port; first and second cylinders each including a tube arched to follow but not deviate radially outward beyond the circumference of the sealing disk, sealingly joined to corresponding the first and second wing side walls around and enclosing each corresponding side wall check valve; a mounting structure rotatably mounted to the upper surface of the sealing disk; tubular first and second pistons extending from opposing sides of the mounting structure and slidably fit within corresponding first and second cylinders, each of the pistons containing a piston check valve oriented to permit air to enter but not to exit the piston, an air release port in each of the first and second pistons between the piston check valve and the mounting structure for releasing air delivered into the piston into the atmosphere, and an air release check valve secured within each of the air release ports and oriented to permit air to exit but not to enter the given first or second piston through the corresponding air release port; a lid upper portion including a hand gripping structure; an engaging structure for interconnecting the lid upper portion and the mounting structure so that the lid upper portion and the mounting structure rotate together; so that rotating the lid upper portion in a first rotational direction advances the first piston into the first cylinder causing air within the first cylinder to advance into the first piston through the piston check valve within the first piston and a portion of air within the first piston to escape through the air release port and the air release check valve in the first piston, and so that rotating the lid upper portion in the first rotational direction at the same time causes the second piston to partially withdraw from the second cylinder, and thereby draw air out of the jar through the wing structure check valve into and through the disk wing structure and into the second cylinder; and so that rotating the lid upper portion in a second rotational direction opposing the first rotational direction advances the second piston into the second cylinder causing air within the second cylinder to advance into the second piston through the piston check valve in the second piston and a portion of the air within the second piston to escape through the air release port and the air release check valve in the second piston, and so that rotating the lid upper portion in a second rotational direction at the same time causes the first piston to partially withdraw from the first cylinder, and thereby draw air out of the jar through the wing structure check valve into and through the disk wing structure and into the first cylinder; so that air is progressively evacuated from the jar by rotating the lid upper portion relative to the lid lower portion in one rotational direction and then in the opposing rotational direction in an oscillating sequence.

The sealing disk optionally includes a central disk tube encircling the central valve opening and containing a vacuum relief valve assembly for controlling air passage through the central valve opening; where the engaging structure is connected to the mounting structure and includes a disk clutch structure including an inner clutch tube which encircles the central disk tube and an outer clutch tube which is substantially concentric with the inner clutch tube, at least one radial abutment wall extending outwardly from the inner clutch tube and meeting and connecting to an outer clutch tube; and where the engaging structure further includes at least one clutch wedge affixed to and extending downwardly from the lid top wall and being sized and positioned to removably fit into the space between the inner clutch tube and the outer clutch tube and against the at least one radial abutment wall, so that rotating the lid upper portion in either rotational direction relative to the lid lower portion causes the at least one clutch wedge to abut the at least one radial abutment wall and in turn rotate the mounting structure and the first and second pistons relative to the sealing disk and relative to the first and second cylinders.

The vacuum jar preferably additionally includes several of the radial abutment walls spaced apart from each other and several of the clutch wedges, the clutch wedges being arranged in a substantially circular series about the center of the lid top wall and being sized and laterally spaced from each other to fit within spaces between the radial abutment walls.

BRIEF DESCRIPTION OF THE DRAWINGS

Various other objects, advantages, and features of the invention will become apparent to those skilled in the art from the following discussion taken in conjunction with the following drawings, in which:

FIG. 1 is a perspective view of the inventive vacuum jar apparatus showing the lid fitted onto the jar and ready for use, and showing the valve disk with the optional finger engaging ring within the preferred recess in the lid top wall.

FIG. 2 is a view as in FIG. 1 with the lid lifted off the jar.

FIG. 3 is a view of the lid alone, showing the lid upper portion lifted partly off the lid lower portion.

DETAILED DESCRIPTION OF THE PREFERRED EMBODIMENTS

Figure 4:
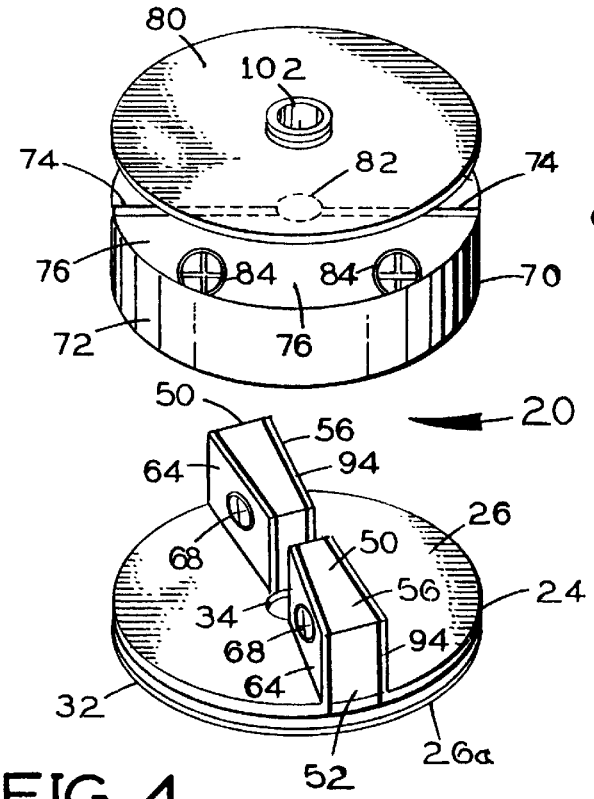
FIG. 4 is a view as in FIG. 3 with the lid upper portion lifted entirely off the lid lower portion, revealing the disk wing portions and the divider duct.

As required, detailed embodiments of the present invention are disclosed herein; however, it is to be understood that the disclosed embodiments are merely exemplary of the invention which may be embodied in various forms. Therefore, specific structural and functional details disclosed herein are not to be interpreted as limiting, but merely as a basis for the claims and as a representative basis for teaching one skilled in the art to variously employ the present invention in virtually any appropriately detailed structure.

Reference is now made to the drawings, wherein like characteristics and features of the present invention shown in the various FIGURES are designated by the same reference numerals.

First Preferred Embodiment

Figure 6:
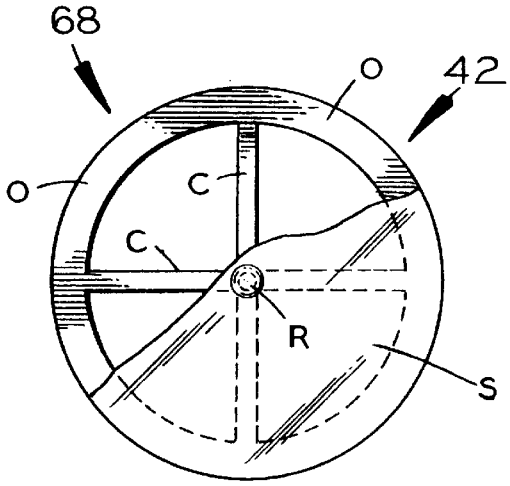
FIG. 6 is a close-up view of the preferred first, second and third check valve design, including a rigid outer ring O and integral cross members C, with a flexible sheet S secured at the center intersection of the cross members by a rivet.
Figure 5:
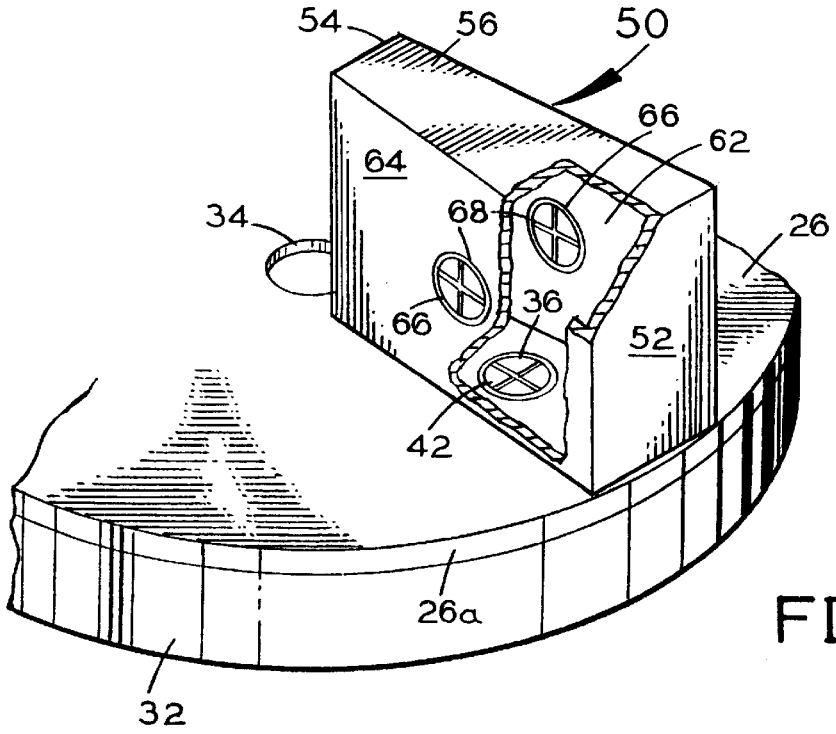
FIG. 5 is a broken away, close-up perspective view of one of the disk wing portions, showing the interior of the disk wing portion and the locations of the air intake and side wall ports.
Figure 6A:
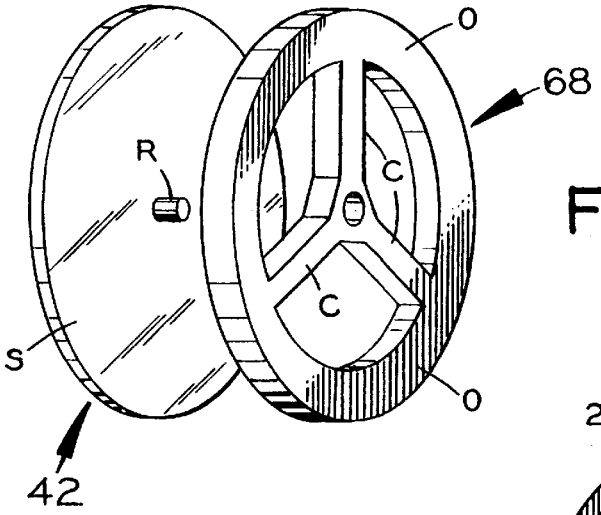
FIG. 6*a* is a perspective view of the preferred valve design of FIG. 6, with the flexible sheet S shown separated and including a central mounting rivet R to fit into the intersection of cross-members C.
Figure 7:
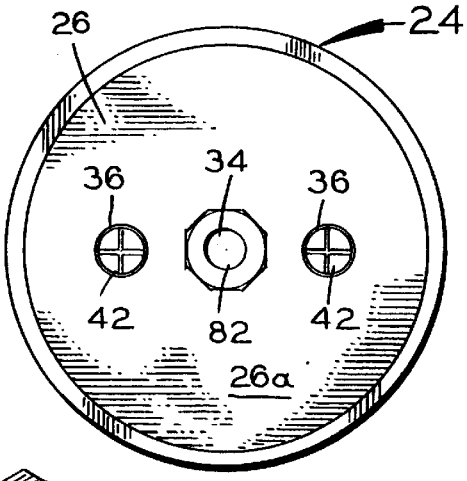
FIG. 7 is a bottom view of the sealing disk, showing the air intake ports, first check valve in the ports, and a decorative nut structure surrounding the center valve opening.
Figure 9:
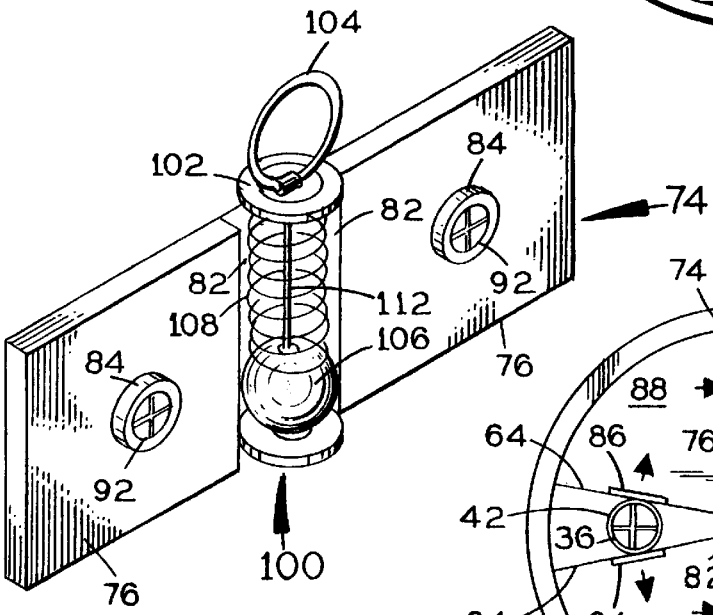
FIG. 9 is a perspective view of the divider duct and vacuum relief passageway containing the vacuum relief valve assembly.
Figure 8:
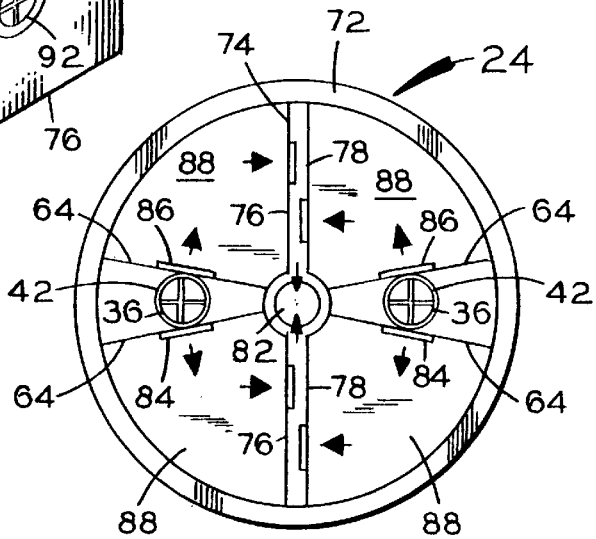
FIG. 8 is a top view of the lid with the lid top wall removed.
Figure 10:
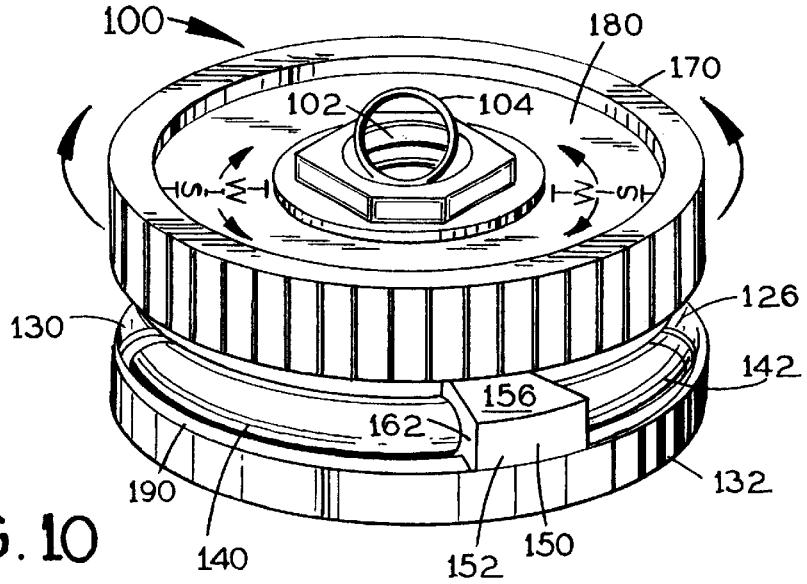
FIG. 10 is a perspective and partially opened view of the second preferred embodiment of the invention, including the piston and cylinder pumping mechanism.

Referring to FIGS. 1–9, a vacuum jar apparatus 10 is disclosed including a vessel which is preferably, although not necessarily, a bell jar 12 with a jar upper rim 14 and a jar wall 16 and a vacuum pump lid 20 which both closes and seals the jar 12 and pumps air out of the sealed jar 12. The lid 20 includes a lid lower portion 24 in the form of a sealing disk 26 having a disk lower face 26*a* covered with a sealing gasket material for extending across and sealing the jar upper rim 14, and having a downwardly extending circumferential lip 32 for receiving the jar upper rim 14 to center the lid 20 on the jar 12. The lid 20 further includes a center valve opening 34 in sealing disk 26, two air intake ports 36 which are preferably diametrically opposed and are each located half way between the valve opening 34 and the circumferential edge of the sealing disk 26 and are fitted with first check valves 42 oriented to pass air exiting the jar 12 and to prevent air from entering the jar 12, a hollow disk wing structure 50 extending upwardly from and sealingly joined to the sealing disk upper face 26*a* and extending over and enclosing the air intake ports 36. See FIG. 5. Each disk wing structure 50 preferably is configured as a truncated wedge-shaped box having a circumferential wing end wall 52 along the edge of the sealing disk 26, a wing center port end wall 54, a wing top wall 56 and two opposing wing side walls 62 and 64. Each wing side wall 62 and 64 has a disk wing side wall port 66 fitted with a second check valve 68 which permits air within the disk wing structure 50 including air drawn from within the jar 12 to exit the disk wing structure 50 over the upper face 26*a* of sealing disk 26.

The lid 20 also includes a lid upper portion 70 in the form of an annular side wall 72 integrally joined to a divider duct 74 which is hollow and extends diametrically across the interior of the annular side wall 72, and a lid top wall 80 either removably or integrally joined to the annular side wall 72. The divider duct 74 includes two duct side walls 76 and 78 and a duct bottom wall 58 and a duct top wall 60, which may or may not be integrally part of lid top wall 80, either way being considered equivalent. The middle of the divider duct 74 contains an upright tubular vacuum relief passageway 82 in fluid communication in both directions with the interior of divider duct 74. Two divider duct ports 84 and 86 are provided in each divider duct side wall 76 and 78, respectively, one on each side of the vacuum relief passageway 82, each duct port 84 and 86 being fitted with a third check valve 92 oriented to pass air into divider duct 74, and thus into tubular vacuum relief passageway 82, and to prevent air from moving out of divider duct 74 through the duct ports 84 and 86. The lateral spaces between the divider duct 74 and the disk wing structures 50 define two air receiving and expulsion chambers 88. Sealing gasket strips 94 are preferably provided on wing structure 50 outer surfaces to place them in sealing relation with annular side wall 72 and lid top wall 80.

As a result of this construction, rotating the lid upper portion 70 in one rotational direction causes divider duct 74 to advance away from one wing side wall 62 or 64 and thereby draw air out of the adjacent disk wing structure 50 through the wing side wall port 66 and into a chamber 88 between the disk wing structure 50 and the divider duct 74 and simultaneously to draw air out of jar 12 and into the disk wing structure 50 through the air intake port. Rotating the lid upper portion 70 in the opposing rotational direction closes the chamber 88 between the disk wing structure 50 and divider duct 74 and thereby causes air previously drawn into the space between the disk wing structure 50 and the divider duct 74 to be forced through one of the divider duct ports 84 and 86 and into the divider duct. Thereupon the air exits lid 20 through vacuum relief passageway 82, so that air within the jar is progressively rarified.

A vacuum relief valve assembly 100 is provided including a valve disk 102 resting on top of the lid top wall 80 and over the vacuum relief passageway 82. A finger engaging ring 104 is pivotally secured to the valve disk 102 upper surface to pivot upright for gripping by a user finger and to pivot down flat against the valve disk 102 so that it is not accidentally bumped and the valve disk 102 dislodged. See FIG. 9. A valve ball 106 is provided within the vacuum relief passageway 82 and sealingly rests in the center valve opening 34 to function as a check valve permitting air to exit the jar 12 through the vacuum relief passageway 82 but not to enter the jar 12. A valve cable 112 longer than the length of passageway 82 minus the valve ball 106 diameter interconnects the valve disk 102 and the valve ball 106. Valve cable 112 retains the valve disk 102 against substantial movement away from the passageway 82 upper opening and yet the length of the cable 112 in excess of the passageway 82 length minus the valve ball 106 diameter permits the valve disk 102 to rise and move laterally from the passageway 82 upper opening to release bursts of air being pumped out of divider duct 74 and jar 12 without dislodging the valve ball 106. A spring 108 encircles cable 112 and biases valve ball 106 into sealing relation with valve center opening 34.

A user wishing to permit air to enter the jar 12 so that the lid 20 can be removed from the jar 12 simply pulls the finger engaging ring 104 upward sufficiently to pull the cable 112 taut, and then pulls the connected valve ball 106 upward, admitting air outside the apparatus through vacuum relief passageway 82 and into jar 12. The lid top wall 80 upper surface is preferably recessed sufficiently at its center to bring the pivoted flat finger engaging ring 104 below the lid 20 profile.

Second Preferred Embodiment

Figure 11:
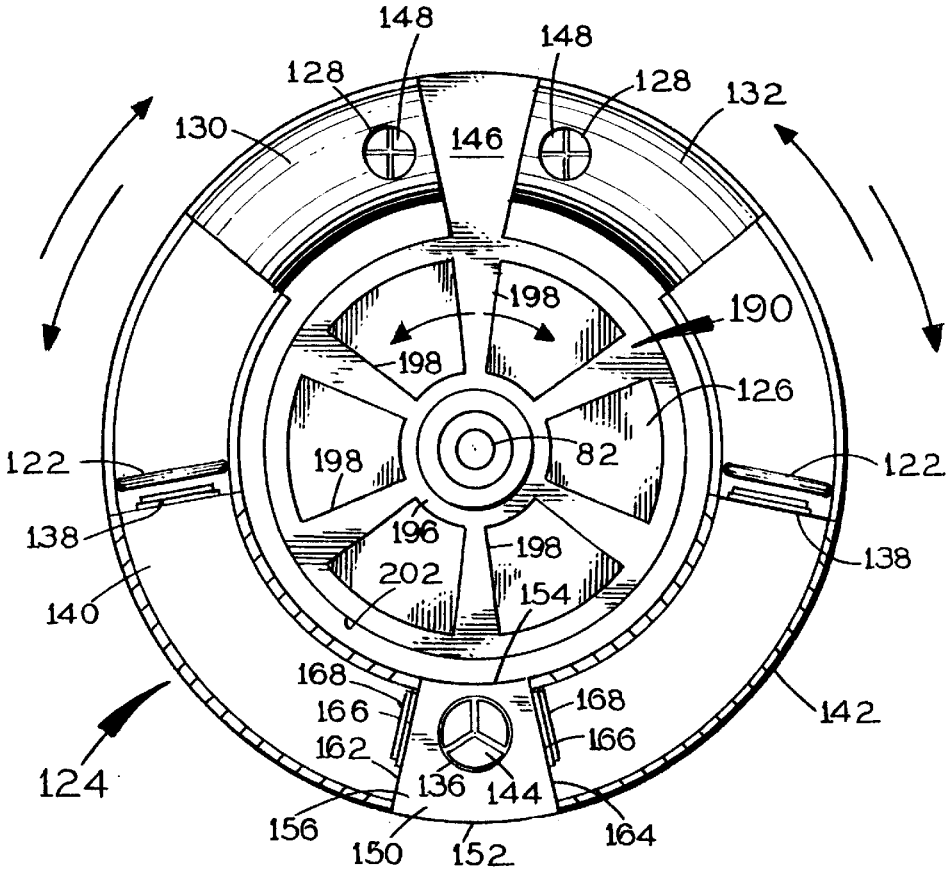
FIG. 11 is a top view of the lid lower portion showing the lid lower portion elements of the clutch structure.
Figure 12:
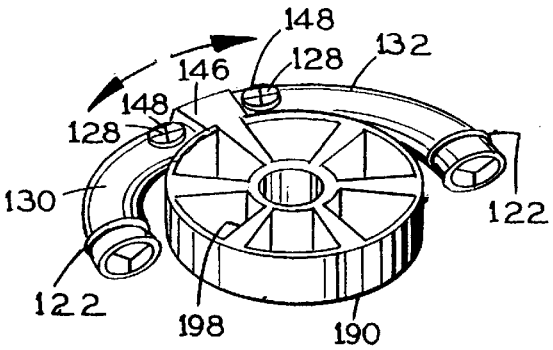
FIG. 12 is a separate, perspective view of the clutch structure honeycombed portion, the mounting structure and the cylinders extending from the mounting structure.
Figure 13:
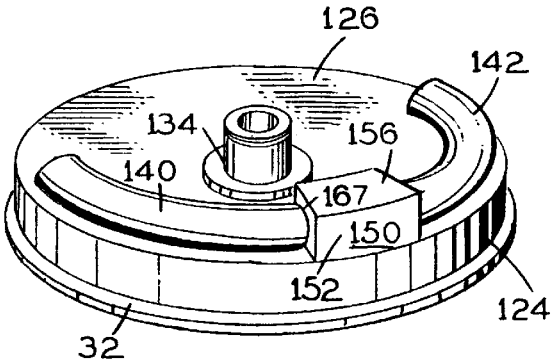
FIG. 13 is a perspective view of the lid lower portion absent the clutch structure, mounting structure and cylinders, showing the wing structure and cylinders.
Figure 15:
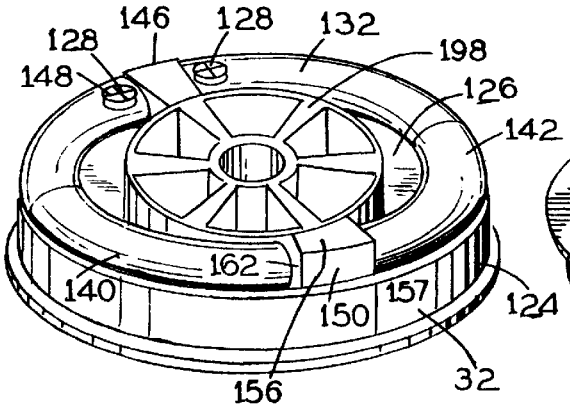
FIG. 15 is a combined view of the elements of FIGS. 12 and 13 showing the pistons operationally inserted into the cylinders, to form the complete lid lower portion.
Figure 14:
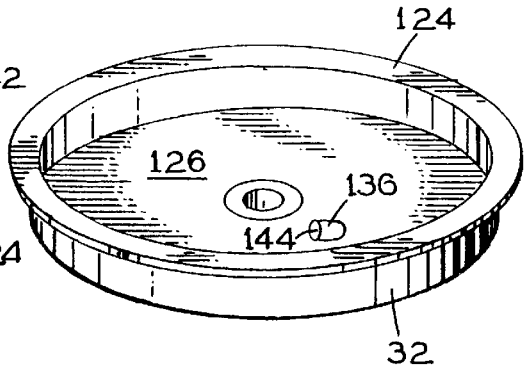
FIG. 14 is an inverted view of the lid lower portion.
Figure 16:
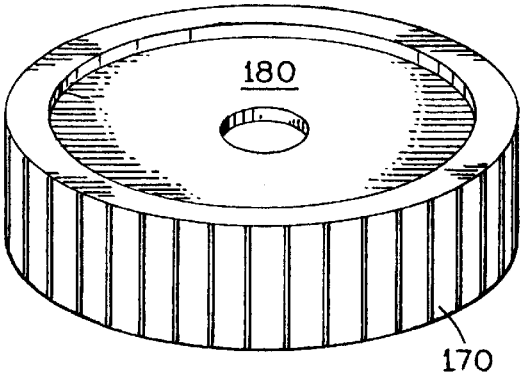
FIG. 16 is a perspective view of the lid top wall and circumferential flange.
Figure 17:
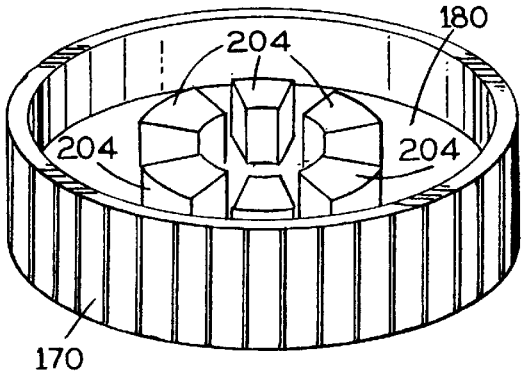
FIG. 17 is an inverted view of the lid top wall and flange of FIG. 16, showing the preferred clutch wedges of the clutch structure.

The second preferred embodiment is similar to the first in general function and operation. The air receiving and expelling chambers 88 are replaced with an arched first piston 130 and arched first cylinder 140 and an arched second piston 132 and arched second cylinder 142. See FIGS. 11–17. Cylinders 140 and 142 are preferably formed of transparent plastic, so that internal operation can be monitored for ease of servicing. Sealing disk 126 has the same general structure as sealing disk 26 of the first preferred embodiment. A single, truncated wing structure 150 is attached at the periphery of the sealing disk 126 upper surface. An air intake port 136 is provided in sealing disk 126, opening into wing structure 150, and contains a wing intake disk valve 142 oriented to pass air from jar 12 into wing structure 150 and to obstruct air passage from wing structure 150 into jar 12. Wing structure 150 includes a wing circumferential wall 152, a wing end wall 154, a wing top wall 156, and opposing wing side walls 162 and 164. Wing side walls 162 and 164 each include a wing side wall port 166 containing a side wall check valve 168 oriented to permit air to exit but not enter wing structure 150. A cylinder 140 in the form of a tube arched to follow but not deviate radially beyond the sealing disk 126 periphery extends from each wing side wall 162 and 164, around and enclosing each side wall check valve 168. A mounting structure preferably in the form of a structural wedge 146 slidably rests on the upper surface of sealing disk 126, being radially oriented on disk 126 so that its wider end follows the disk 126 circumference, and generally opposes wing structure 150. First and second tubular pistons 130 and 132 extend from opposing sides of structural wedge 146 and slidably fit within corresponding first and second cylinders 140 and 142, respectively. Each tubular piston 130 and 132 has a piston check valve 138 secured with ann O-ring 122 within its remote, free end, and oriented to permit air to enter but not to exit the piston. An air release port 128 is provided in each piston 130 and 132 adjacent to structural wedge 146 to release pumped air into the atmosphere, and an air release check valve 148 is secured within each air release port 128 and oriented to permit air to exit but not to enter piston 130 and 132 through ports 128.

Sealing disk 126 includes a central disk tube 182 encircling center valve opening 134 at the center of disk 126 containing the vacuum relief valve assembly of the first embodiment, which controls air passage through a center valve opening 134 at the sealing disk 126 center. A honeycombed, circular disk clutch structure 190 is provided which encircles central disk tube 182 and is integrally connected to structural wedge 146. See FIGS. 11, 12 and 15. Disk clutch structure 190 is separate from and is rotatably movable relative to sealing disk 126, and includes a central tube 196. Radial abutment walls 198 extend from the outer surface of central tube 196 and meet and connect to an outer disk clutch tube 202. A circular series of laterally spaced apart clutch wedges 204 extend downwardly from lid top wall 180 and are sized and spaced to removably fit into the spaces between abutment walls 198, so that rotating the lid upper portion 170 in either direction causes the clutch wedges 204 to abut each adjacent abutment wall 198 and in turn rotate structural wedge 146 and pistons 130 and 132 relative to sealing disk 126 and cylinder 140 and 142.

Rotating lid upper portion 170 in a first rotational direction advances a first piston 130 into a first cylinder 140 causing air within the first cylinder 140 to advance into first piston 130 through the piston check valve 138 and a portion of the air already within first piston 130 to escape through the air release port 128 and air release check valve 148 in first piston 130. At the same time, this rotation causes a second piston 132 to partially withdraw from second cylinder 142, and thereby draw air out of jar 12 through check valve 144 into and through disk wing structure 150 and into second cylinder 142.

Rotating lid upper portion 170 in a second rotational direction advances second piston 132 into second cylinder 142 causing air within second cylinder 142 to advance into second piston 132 through the piston check valve 138 and a portion of the air already within second piston 132 to escape through the air release port 128 and air release check valve 148 in second piston 132. At the same time, this rotation causes first piston 130 to partially withdraw from first cylinder 140, and thereby draw air out of jar 12 through check valve 144 into and through disk wing structure 150 and into first cylinder 140. In this way air is progressively evacuated from jar 12 by rotating the lid upper portion 170 relative to lid lower portion 124 in one direction and then in the other direction, in an oscillating movement.

While the invention has been described, disclosed, illustrated and shown in various terms or certain embodiments or modifications which it has assumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

I claim as my invention:

1. A vacuum jar apparatus, comprising, a jar having a jar wall terminating at a jar upper end in a jar opening surrounded and defined by a jar upper rim;

and a jar lid structure comprising a sealing panel for resting against said jar upper rim and closing and sealing said jar, and means for evacuating air from within said jar wherein said sealing panel is a sealing disk having a circumferential edge and a sealing disk upper face and a sealing disk lower face, and wherein said means for evacuating air comprises:

a substantially central valve opening in said sealing disk;

at least one air intake port in said sealing disk located between said valve opening and the circumferential edge of said sealing disk, said air intake port being fitted with a check valve oriented to pass air exiting said jar and to prevent air from entering said jar through said air intake port;

a hollow disk wing structure extending upwardly from and sealingly joined to said sealing disk upper face and extending over and enclosing said air intake port, said disk wing structure being configured substantially as a truncated wedge-shaped box having a circumferential wing outer end wall along the circumferential edge of said sealing disk, a wing inward end wall along said intake port, and a wing top wall and two opposing wing side walls sealingly interconnected to both of said wing end walls, each said wing side wall having a wing side wall port fitted with a check valve oriented to permit air within the disk wing structure including air drawn up from said jar to exit said disk wing structure over said sealing disk upper face;

a lid upper portion comprising an annular side wall integrally joined to a hollow divider duct extending diametrically across the interior of said annular side wall, and a lid top wall joined to said annular side wall and to said lid top wall, said tubular divider duct including two duct side walls and a duct top wall, a substantially central upright tubular vacuum relief passageway in fluid communication with said tubular divider duct and opening through said lid top wall, two divider duct ports in each divider duct side wall, one on each side of said vacuum relief passageway, each said duct port being fitted with a check valve oriented to pass air into said tubular divider duct, and into said vacuum relief passageway and to prevent air from moving out of said tubular divider duct through said duct ports, said divider duct and said disk wing structure defining between them two air receiving and expelling chambers;

a closure means at the lower end of said vacuum relief passageway for preventing air from exiting said jar through said vacuum relief passageway;

such that rotating said lid upper portion in one rotational direction causes said divider duct to advance away from one wing side wall and thereby draw air out of said disk wing structure through said wing side wall port and into a chamber between said disk wing structure and said divider duct and simultaneously to draw air out of said jar and into said disk wing structure through said air intake port, and rotating said lid upper portion in the opposing rotational direction closes the chamber between said disk wing structure and said divider duct and thereby causes air previously drawn into the space between said disk wing structure and said divider duct to be forced through one of said divider duct ports and into said divider duct, whereupon said air exits said lid structure through said vacuum relief passageway, such that air within said jar is progressively rarified.

2. A vacuum jar according to claim 1, wherein said closure means is a valve ball removably fitted within said passageway and sealingly seated into said valve opening for permitting air to exit but not to enter said jar through said vacuum relief passageway, additionally comprising a vacuum relief valve assembly, comprising:

a valve disk resting on top of said lid top wall and over said vacuum relief passageway;

a finger engaging ring pivotally secured to said valve disk upper surface to pivot upright for gripping by a user finger and to pivot down against said valve disk such that said ring is not accidentally bumped and the valve disk dislodged from said passageway;

a valve cable interconnecting said valve disk and said valve ball;

such that said cable permits said valve disk to rise and move laterally from said passageway upper opening to release air pumped out of the chamber and jar without dislodging the valve ball, and permits a user to admit air into said jar to equalize pressure between the interior of the jar and the surrounding atmosphere such that said lid structure is readily removably from said jar by pulling said finger engaging ring upwardly and thereby pulling said cable taut and pulling further to lift said valve ball off said valve opening, admitting air outside the apparatus through said vacuum relief passageway and into said jar.

3. A vacuum jar according to claim 1, wherein said lower face of said sealing disk comprises sealing gasket material for contacting and sealing said jar upper rim and wherein said sealing disk comprises a downwardly extending circumferential lip for receiving said jar rim to center said lid structure on said jar.

4. A vacuum jar according to claim 1, comprising two said air intake ports which are diametrically opposed and are each located half way between said valve opening and said circumferential edge of said sealing disk.

5. A vacuum jar according to claim 1, wherein said lid top wall has a top wall upper surface which is recessed sufficiently at its center to bring said finger engaging ring below the level of the remainder of said lid upper surface when said finger engaging ring is pivoted down against said lid top wall.

6. A vacuum jar apparatus, comprising;

a jar having a jar wall terminating at a jar upper end in a jar opening surrounded and defined by a jar upper rim;

and a jar lid structure comprising a sealing panel for resting against said jar upper rim and closing and sealing said jar, and means for evacuating air from within said jar, wherein said sealing panel is a sealing disk having a circumferential edge and a sealing disk upper face and a sealing disk lower face, and wherein said means for evacuating air comprises;

a substantially central valve opening in said sealing disk;

a hollow disk wing structure extending upwardly from and sealingly joined to said sealing disk upper face, said disk wing structure being configured substantially as a box having a wing outer end wall adjacent to said circumferential edge of said sealing disk, a wing inward end wall, and a wing top wall and two opposing wing side walls sealingly interconnected to both of said wing end walls, each said wing side wall having a wing side wall port fitted with a wing side wall check valve oriented to permit air within said disk wing structure to exit said disk wing structure over said sealing disk upper face;

at least one wing structure air intake port in said sealing disk located between said valve opening and said circumferential edge of said sealing disk and opening inside said disk wing structure, said air intake port being fitted with a wing structure check valve oriented to pass air exiting said jar and to prevent air from entering said jar through said wing structure air intake port; first and second cylinders each comprising a tube arched to follow but not deviate radially outward beyond the circumference of said sealing disk, sealingly joined to corresponding said first and second wing side walls around and enclosing each corresponding side wall check valve;

a mounting structure rotatably mounted to the upper surface of said sealing disk;

tubular first and second pistons extending from opposing sides of said mounting structure and slidably fit within corresponding said first and second cylinders, each said piston containing a piston check valve oriented to permit air to enter but not to exit said piston, an air release port in each of said first and second pistons between said piston check valve and said mounting structure for releasing air delivered into said piston into the atmosphere, and an air release check valve secured within each said air release port and oriented to permit air to exit but not to enter said first and second pistons through the corresponding said air release port;

a lid upper portion comprising hand gripping means;

engaging means for interconnecting said lid upper portion and said mounting structure such that said lid upper portion and said mounting structure rotate together;

such that rotating said lid upper portion in a first rotational direction advances said first piston into said first cylinder causing air within said first cylinder to advance into said first piston through the piston check valve within said first piston and a portion of air within said first piston to escape through said air release port and the air release check valve in said first piston, and such that rotating said lid upper portion in the first rotational direction at the same time causes said second piston to partially withdraw from said second cylinder, and thereby draw air out of said jar through said wing structure check valve into and through said disk wing structure and into said second cylinder;

and such that rotating said lid upper portion in a second rotational direction opposing the first rotational direction advances said second piston into said second cylinder causing air within said second cylinder to advance into said second piston through the piston check valve in said second piston and a portion of the air within said second piston to escape through the air release port and the air release check valve in said second piston, and such that rotating said lid upper portion in a second rotational direction at the same time causes said first piston to partially withdraw from said first cylinder, and thereby draw air out of said jar through said wing structure check valve into and through said disk wing structure and into said first cylinder; such that air is progressively evacuated from said jar by rotating said lid upper portion relative to said lid lower portion in one rotational direction and then in the opposing rotational direction in an oscillating sequence.

7. A vacuum jar according to claim 6, wherein said sealing disk comprises a central disk tube encircling said central valve opening and containing a vacuum relief valve assembly for controlling air passage through said central valve opening;

wherein said engaging means is connected to said mounting structure and comprises a disk clutch structure including an inner clutch tube which encircles said central disk tube and an outer clutch tube which is substantially concentric with said inner clutch tube, at least one radial abutment wall extending outwardly from said inner clutch tube and meeting and connecting to an outer clutch tube;

and wherein said engaging means further comprises at least one clutch wedge affixed to and extending downwardly from said lid top wall and being sized and positioned to removably fit into the space between said inner clutch tube and said outer clutch tube and against said at least one radial abutment wall, such that rotating said lid upper portion in either rotational direction relative to said lid lower portion causes said at least one clutch wedge to abut said at least one radial abutment wall and in turn rotate said mounting structure and said first and second pistons relative to said sealing disk and relative to said first and second cylinders.

8. A vacuum jar according to claim 7, comprising a plurality of said radial abutment walls spaced apart from each other and a plurality of said clutch wedges, said clutch wedges being arranged in a substantially circular series about the center of said lid top wall and being sized and laterally spaced from each other to fit within spaces between said radial abutment walls.

* * * * *